US007299848B2

(12) United States Patent
Streib et al.

(10) Patent No.: US 7,299,848 B2
(45) Date of Patent: Nov. 27, 2007

(54) CLOSURE MEMBER CONTROL SYSTEMS, INCLUDING DOOR CONTROL SYSTEMS FOR BARRIER HOUSINGS, AND ASSOCIATED METHODS

(75) Inventors: Tasche L. Streib, Boise, ID (US); James Nolan Cloninger, Boise, ID (US)

(73) Assignee: Smoke Guard, Inc., Boise, ID (US)

( * ) Notice: Subject to any disclaimer, the term of this patent is extended or adjusted under 35 U.S.C. 154(b) by 325 days.

(21) Appl. No.: 11/105,132

(22) Filed: Apr. 12, 2005

(65) Prior Publication Data

US 2006/0226103 A1 Oct. 12, 2006

(51) Int. Cl.
*E05F 15/20* (2006.01)

(52) U.S. Cl. ..... 160/9; 160/29; 160/243

(58) Field of Classification Search ..... 160/23.1, 160/24, 243, 1, 7, 9, 29; 16/65, 280, 291, 16/68; 169/48, 49, 50, 51
See application file for complete search history.

(56) References Cited

U.S. PATENT DOCUMENTS

| | | | | |
|---|---|---|---|---|
| 862,644 | A | 8/1907 | Kepler | |
| 2,564,208 | A | 8/1951 | Michelman | |
| 2,582,276 | A | 1/1952 | Powers | |
| 3,006,352 | A | 10/1961 | Hozak | |
| 3,016,952 | A | 1/1962 | Shero | |
| 3,306,345 | A | 2/1967 | Youngs | |
| 3,398,779 | A | 8/1968 | Kuss | |
| 3,687,185 | A | 8/1972 | Singer | |
| 3,766,958 | A | 10/1973 | Mitchell | |
| 3,807,480 | A | 4/1974 | Smart | |
| 3,877,525 | A | 4/1975 | Husson et al. | |
| 3,955,330 | A | 5/1976 | Wendt | |
| 3,960,216 | A | 6/1976 | Isobe | |
| 3,964,214 | A | 6/1976 | Wendt | |
| 4,077,474 | A * | 3/1978 | Hattori | 169/48 |
| 4,079,772 | A | 3/1978 | Klaenhammer | |
| 4,398,371 | A | 8/1983 | Jenkins | |
| 4,802,523 | A | 2/1989 | Scholten | |
| 5,056,839 | A * | 10/1991 | Yoon | 293/117 |
| 5,195,594 | A * | 3/1993 | Allen et al. | 169/48 |

(Continued)

FOREIGN PATENT DOCUMENTS

| | | |
|---|---|---|
| CH | 560833 | 4/1975 |

(Continued)

*Primary Examiner*—David Purol
(74) *Attorney, Agent, or Firm*—Perkins Coie LLP

(57) ABSTRACT

Closure member control systems, including door control systems for barrier housings, and associated methods are disclosed. One aspect of the invention is directed toward a closure member control system that includes a closure member positioned to cover a portion of an opening in a structure (e.g., a barrier housing). The closure member has a closed position where the closure member covers the portion of the opening and an open position where the closure member does not cover the portion of the opening. The system further includes a control device operatively coupled to the closure member that urges the closure member to remain in the closed position when the closure member is in the closed position and urges the closure member to remain in the open position when the closure member is in the open position. In certain embodiments, the control device can include at least one forcing mechanism.

10 Claims, 4 Drawing Sheets

U.S. PATENT DOCUMENTS

| | | | | |
|---|---|---|---|---|
| 5,383,510 | A * | 1/1995 | Allen | 160/310 |
| 5,482,103 | A | 1/1996 | Burgess | |
| 5,607,758 | A | 3/1997 | Schwartz | |
| 5,836,424 | A | 11/1998 | Allen | |
| 5,862,851 | A | 1/1999 | Stoebich | |
| 5,896,907 | A | 4/1999 | Dever | |
| 6,070,640 | A | 6/2000 | Miyagawa | |
| 6,138,739 | A | 10/2000 | Crider | |
| 6,357,507 | B1 | 3/2002 | Stoebich | |
| 6,715,183 | B1 * | 4/2004 | Lautenschlager | 16/286 |
| 2003/0051829 | A1 * | 3/2003 | Sears et al. | 160/243 |

FOREIGN PATENT DOCUMENTS

| | | |
|---|---|---|
| DE | 19718238 A1 | 11/1998 |
| EP | 1249255 | 10/2002 |
| FR | 2617230 | 6/1990 |
| GB | 2060744 | 5/1981 |
| GB | 2108839 | 5/1983 |
| GB | 2202890 | 10/1988 |
| WO | WO 97/43011 | 11/1997 |

* cited by examiner

CLOSURE MEMBER CONTROL SYSTEMS, INCLUDING DOOR CONTROL SYSTEMS FOR BARRIER HOUSINGS, AND ASSOCIATED METHODS

TECHNICAL FIELD

Embodiments of the present invention relate to closure member control systems, including door control systems for barrier housings (e.g., housings for smoke curtain assemblies), and associated methods.

BACKGROUND

Various smoke barrier systems often contain a barrier in a housing with a door, and the door is movable between at least two positions. For example, a drop-down smoke curtain can be contained in a housing above a doorway. The curtain can be configured to drop down through an opening in the bottom of the housing to cover doorways, for example, during a fire. The curtains, when deployed, prevent smoke or fire from passing through the doorway. When the curtain is stored in the housing, it can be desirable to cover the opening in the bottom of the housing with one or more movable doors. For example, it can be desirable to cover the opening for aesthetic purposes, to prevent unwanted foreign objects from being placed in the housing, to prevent tampering with the curtain assembly, or to prevent unauthorized access into the housing. When one or more doors are used to cover the housing's bottom opening, the doors must not interfere with deployment of the curtain to cover the doorway.

SUMMARY

The present invention is directed generally toward closure member control systems, including door control systems for barrier housings, and associated methods. One aspect of the invention is directed toward a closure member control system that includes a housing having an interior, an opening to the interior, and a closure member. The closure member can be movable relative to the opening between open and closed positions. In the closed position, the closure member can cover at least a portion of the opening. In the open position, the closure member does not cover the portion(s) of the opening. The system can further include a barrier coupled to the housing. The barrier can be moveable between a stowed position and a deployed position. In the stowed position, the barrier can be contained in the housing's interior. In the deployed position, the barrier can extend past the opening. The system can still further include a control device operatively coupled to the closure member. The control device can be movable between first and second positions relative to the housing. The control device can be positioned to urge the closure member to remain in the closed position when the closure device is in the first position and to urge the closure member to remain in the open position when the closure device is in the second position.

Another aspect of the invention is directed toward a closure member control system that includes a housing having an interior, an opening to the interior, and a closure member. The closure member can be movable relative to the opening between open and closed positions. In the closed position, the closure member can cover at least a portion of the opening. In the open position, the closure member does not cover the portion(s) of the opening. The system can further include a barrier coupled to the housing. The barrier can be moveable between a stowed position and a deployed position. In the stowed position, the barrier can be contained in the housing's interior. In the deployed position, the barrier can extend past the opening. The system can still further include an over-center spring device operatively coupled to the closure member. The over-center spring device can include at least one spring and can be movable between at least two positions, including a first position and a second position. In the first position, the spring can be positioned to urge the closure member to remain in the closed position. In the second position, the spring can be positioned to urge the closure member to remain in the open position.

Still another aspect of the invention is directed toward a method for controlling a position of a closure member that includes positioning a barrier in a stowed position where the barrier is generally located in an interior of a housing. In the stowed position, the barrier does not extend through an opening between an exterior of the housing and the interior of the housing. The method can further include covering at least a portion of the opening with a closure member when the closure member is in a closed position and urging the closure member to remain in the closed position with a control device. The method can still further include moving the closure member from the closed position to an open position, moving the barrier to a deployed position where a portion of the barrier extends past the opening, and urging the closure member to remain in the open position with the control device when the barrier is in the deployed position.

DETAILED DESCRIPTION

The present disclosure describes closure member control systems, including door control systems for barrier housings, and associated methods. Several specific details of the invention are set forth in the following description and in FIGS. 1-4D to provide a thorough understanding of certain embodiments of the invention. One skilled in the art, however, will understand that the present invention may have additional embodiments, and that other embodiments of the invention may be practiced without several of the specific features described below. For example, closure member control systems are discussed below in the context of a door control system used to control the position of a door coupled to a barrier housing. One skilled in the art, however, will recognize that the closure member control system can be used with other closure members having at least two operative stationary positions.

Figure 1:
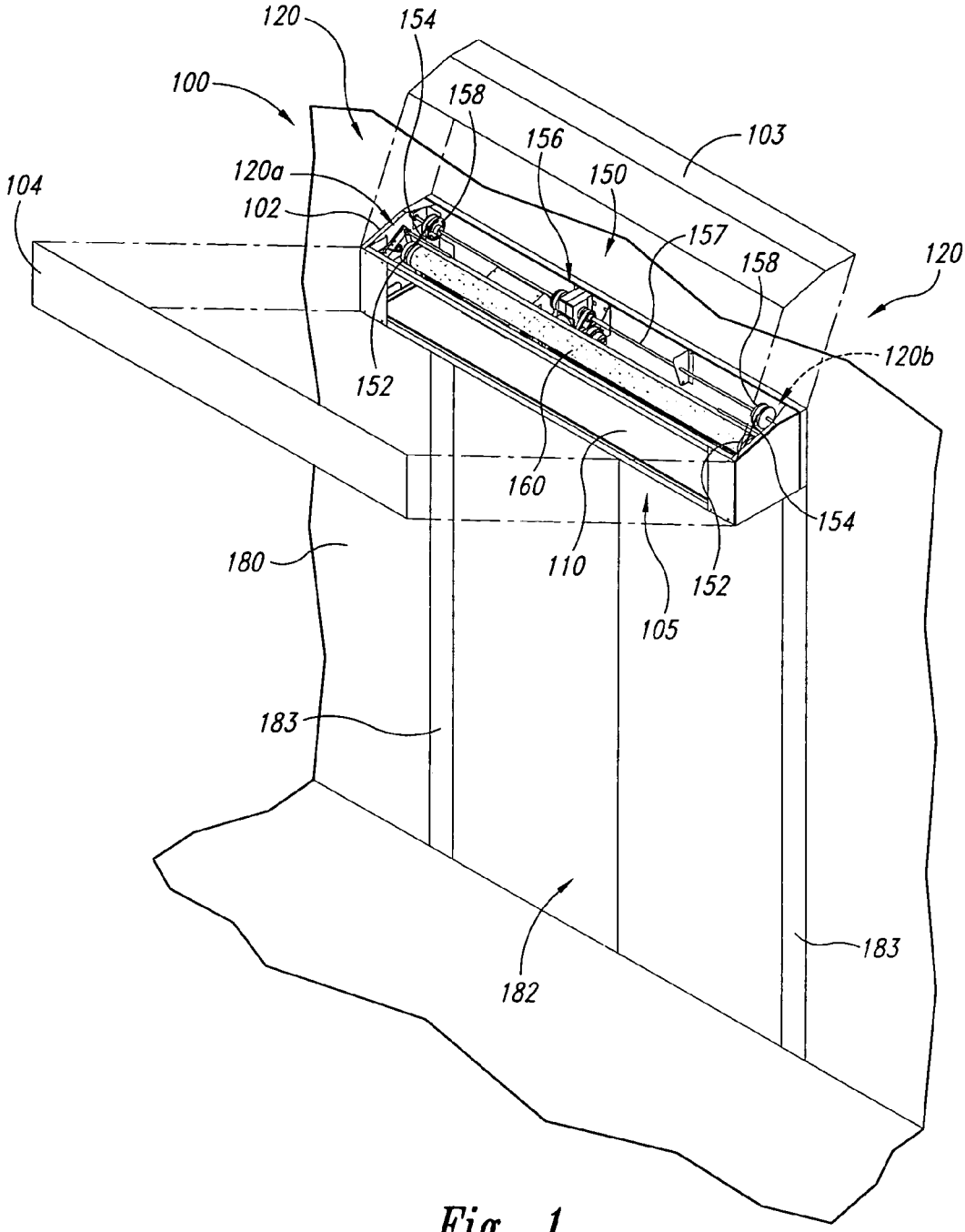
FIG. 1 is an isometric illustration of a closure member control system with a closure member in a closed position and a barrier in a stowed position, in accordance with embodiments of the invention.

FIG. 1 is an isometric illustration of a closure member control system 100 having at least one control device coupled to a closure member of a structure or housing 102, in accordance with embodiments of the invention. In FIGS. 1-4D the control devices are shown as over-center spring devices 120 and the closure member is shown as a door 110. In other embodiments, control device and/or the closure member can have other arrangements. For example, in certain embodiments the control device includes a forcing member that is not a spring and the closure member includes a movable panel instead of the door 110.

In the illustrated embodiment, the housing 102 is mounted to a wall 180 above an aperture 182, such as a doorway or a hoistway entrance. In the illustrated embodiment, the housing 102 is formed by a series of panels. The top panel 103 of the housing 102 and the front panel 104 of the housing 102 are shown in FIG. 1 in an exploded configuration for the purposes of illustration. The housing 102 is configured to contain a barrier 160 that can be deployed through an opening 105 in the housing 102 to cover at least a portion of the aperture 182. For example, the barrier 160 can include a heat resistant and smoke-impermeable material, so the barrier 160 can be used to temporarily seal the aperture 182 during a fire condition to prevent smoke from transiting the aperture 182. In other embodiments, when the barrier 160 is in the stowed position one or more portions of the barrier 160 can extend beyond the confines of the housing 102.

In FIG. 1, the door 110 is movable relative to the housing 102 between at least an open position and a closed position. In the closed position, the door 110 covers at least a portion of the housing's opening 105. In the open position, the door 110 is away from the housing so it does not cover the opening 105. When the door 110 is in the closed position, the over-center spring devices 120 releasably retain the door 110 in the closed position. In one embodiment, the over-center spring devices 120 hold the door 110 in the closed position. When the door 110 is in the open position, the over-center spring device 120 releasably retains the door 110 in the open position. In one embodiment, the over-center spring device 120 holds the door 110 in the open position.

In FIG. 1, the closure member control system 100 includes two over-center spring devices 120 coupled to the housing 102 and to the door 110. The illustrated embodiment includes a first over-center spring device 120*a* in the left side of the housing and a second over-center spring device 120*b* in the right side of the housing. In other embodiments, the closure member control system 100 can include more or fewer over-center spring devices 120. When the door 110 is placed in the closed position, the over-center spring devices 120 releasably retain the door 110 in the closed position. In one embodiment, the over-center spring devices 120 are biased and urge the door 110 to remain in the closed position when the barrier 160 is in the stowed position.

In the illustrated embodiment, the door 110 can be moved to the open position to allow the barrier 160 to be deployed from the stowed position. When the barrier 160 is deployed, it unrolls or otherwise extends through the housing's opening 105. When the barrier 160 is fully deployed and in a deployed position, it covers at least a portion of the aperture 182 in the wall 180. Once the door 110 is moved to the open position, the over-center spring devices 120 can then retain the door 110 in the open position. In one embodiment, the over-center spring devices 120 are also biased and urge the door 110 to remain in the open position. In another embodiment, the over-center spring devices 120 are configured to positively move the door 110 toward the open position and to block the door 110 from inadvertently moving back toward the closed position. When the barrier 160 is rolled back up or otherwise returned to the stowed position and the door 110 is moved back to the closed position, the over-center spring device 120 can again releasably retain the door 110 in the closed position.

Figure 2:
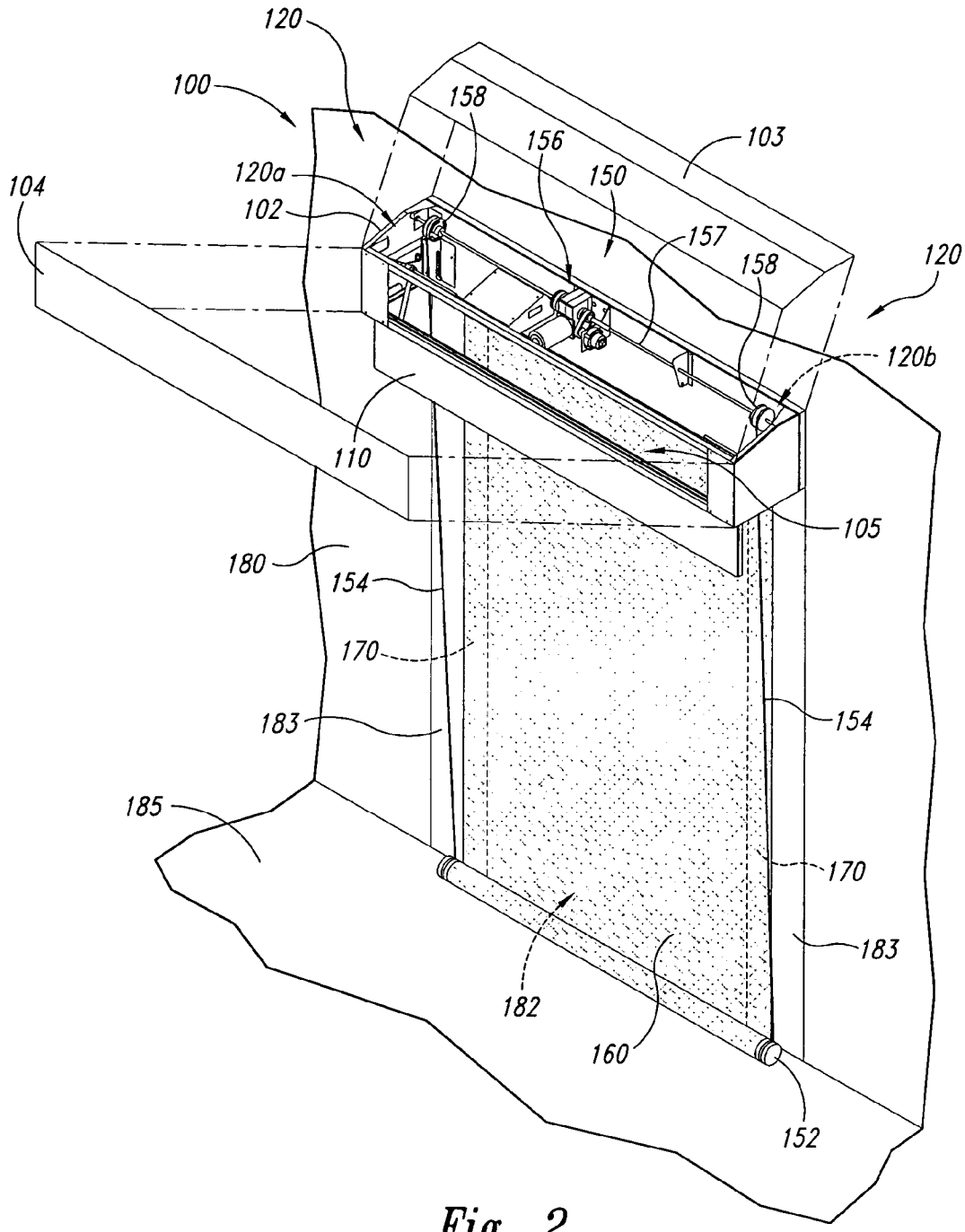
FIG. 2 is an isometric illustration of the closure member control system of FIG. 1, with the closure member in the open position and the barrier in a deployed position.

FIG. 2 is an isometric illustration of the closure member control system 100 shown in FIG. 1 with the door 110 in the open position and the barrier 160 in the deployed position. In certain embodiments, the barrier 160 can include a sealing mechanism 170 to seal the barrier 160 against edge portions or sides 183 of the aperture 182 when the barrier 160 is in the deployed position. For example, in FIG. 2 the barrier 160 has sealing mechanisms 170 that include a flexible magnetic material that seal the edges of the barrier 160 against metallic edge portions of the aperture 182 when the barrier 160 is in the deployed position. Additionally, the barrier 160 is unwound from a spool 152 which rests on the floor 185 when the barrier 160 is in the deployed position, thereby forming a seal at the bottom of the aperture 182. In the illustrated embodiment, a top portion of the barrier 160 can be coupled to the housing 102 and/or the wall 180 to aid in sealing the top portion of the aperture 182. In other embodiments, the barrier can include other sealing arrangements (e.g., a track system) or no sealing mechanisms.

In certain embodiments, drive mechanism 150 can be positioned to move the barrier 160 to the stowed and/or the deployed position. In the illustrated embodiment, the drive mechanism 150 includes a drive motor 156 coupled to a drive shaft 157. The drive shaft 157 is coupled to two pulleys 158 coupled to cords 154. The barrier 160 is positioned to be wound around the spool 152, which is coupled to the cords 154, similar to drive mechanisms disclosed in U.S. patent application Ser. No. 10/172,685, entitled SYSTEM AND METHOD FOR SEALING OPENING IN RESPONSE TO SMOKE, NOXIOUS FUMES, OR CONTAMINATED AIR USING A ROLL-DOWN BARRIER, filed Jun. 13, 2002, and U.S. patent application Ser. No. 10/949,686, entitled SYSTEM AND METHOD FOR SEALING OPENING IN RESPONSE TO SMOKE, NOXIOUS FUMES, OR CONTAMINATED AIR USING A ROLL-DOWN BARRIER, filed Sep. 24, 2004; both of which are fully incorporated herein by reference. In other embodiments, the barrier 160 can be moved using other arrangements. For example, in certain embodiments the barrier 160 can be raised and/or lowered manually or by using a different type of drive mechanism.

In the illustrated embodiment, the spool 152 and barrier 160 are retained in the stowed position by the drive mechanism 150. The drive mechanism 150 is configured to allow the drive shaft to turn, which in turn can allow gravity to lower the spool 152 and unwind the barrier 160 so the barrier moves to the deployed position covering the aperture 182. In certain embodiments, as the barrier 160 begins deployment from the stowed position, a portion of the barrier 160 and/or the spool 152 presses against the door 110 and pushes the door 110 from the closed to the open position. In other embodiments, the door 110 can be moved from the closed position to the open position without the spool 152 or barrier 160 contacting the door 110. For example, the door 110 can be manually moved from the closed position to the open position and/or moved by an electrical drive motor simultaneous with the barrier beginning its deployment from within the housing.

Figure 3B:
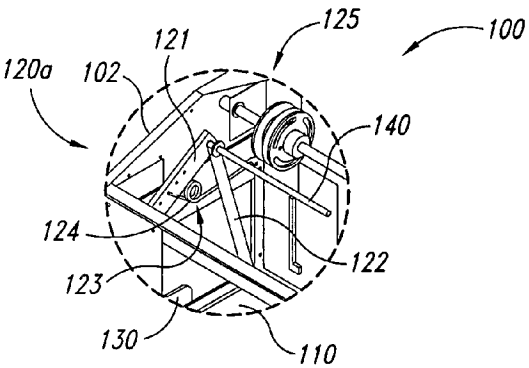
FIG. 3B is an enlarged isometric illustration of a portion of the closure member control system of FIG. 3A.
Figure 3D:
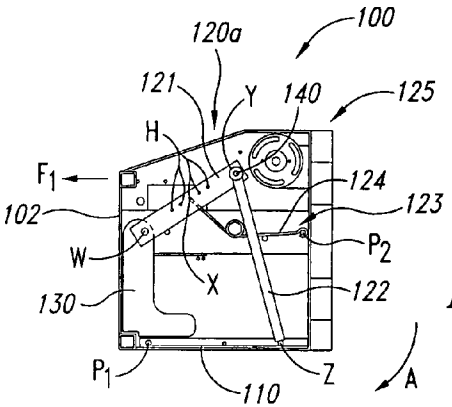
FIG. 3D is an enlarged cross-sectional side elevation view of the closure member control system taken substantially along line 3D-3D of FIG. 3C.
Figure 3A:
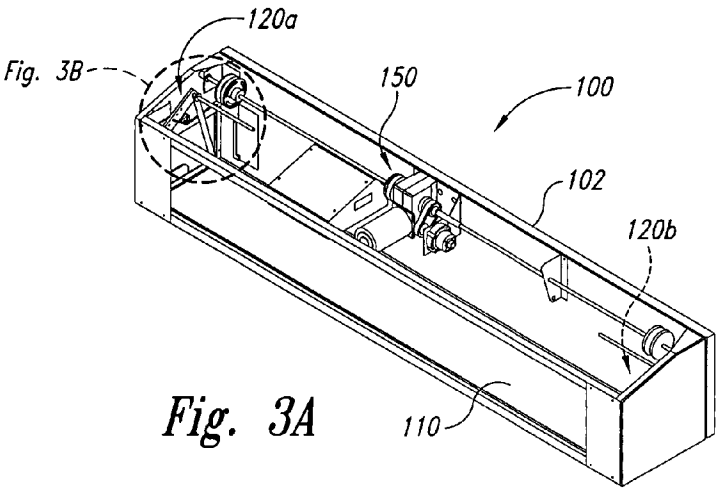
FIG. 3A is an enlarged isometric illustration of the closure member control system of FIG. 1 with the barrier removed and the closure member in a closed position.
Figure 3C:
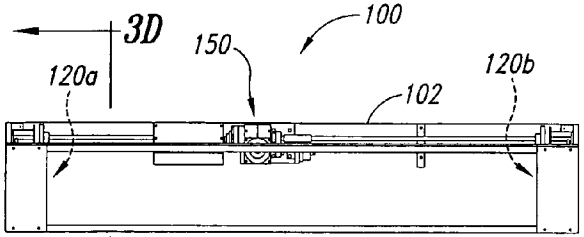
FIG. 3C is a partially schematic front elevation view of the closure member control system shown in FIG. 3A.

FIG. 3A is an enlarged isometric illustration of the closure member control system 100 of FIG. 1 shown without the barrier 160 for purposes of clarity. The front panel 104 of the housing 102 and the top panel 103 of the housing 102 are also shown in an exploded configuration for the purpose of illustration. FIG. 3B is an enlarged isometric illustration of the first over-center spring device 120*a* shown in FIG. 3A. FIG. 3C is a partially schematic front elevation view of the closure member control system 100 shown in FIG. 3A. FIG. 3D is an enlarged cross-sectional side elevation view taken substantially along line 3D-3D of FIG. 3C. In FIGS. 3A-3D, the first over-center spring device 120*a* is shown in a first position where the door 110 is in a closed position. In the illustrated embodiment, the second over-center spring device 120*b* (FIG. 3B) is configured and operates in a substantially similar manner as the first over-center spring device 120*a*. Accordingly, for the purpose of illustration, only the operation of the first over-center spring device 120*a* is discussed and it is to be understood that the discussion is also applicable to the second over-center spring device 120*b*.

The over-center spring device 120*a* of the illustrated embodiment is an over-center mechanism that includes a first link 121 pivotally coupled at one end to the housing 102. The first link 121 is pivotally coupled at its other end to a second link 122 at point Y. The second link 122 is also pivotally coupled to the door 110 at point Z. The first over-center spring device 120*a* also includes a forcing mechanism 123 pivotally coupled at one end to an intermediate portion of the first link 121 at point X. The forcing mechanism 123 is pivotally coupled at another end to the housing 102 at point $P_2$. In the illustrated embodiment, the forcing mechanism 123 includes an integral spring 124. In other embodiments, the forcing mechanism 123 can include more or fewer springs and/or other biasing mechanisms (e.g., when the control device is not an over-center spring device 120).

When the over-center spring device 120*a* is in a first position (shown in FIGS. 3A-3D), the forcing mechanism 123 is positioned to provide a first force $F_1$ (shown in FIG. 3D) to releasably retain the door 110 in the closed position. For example, the forcing mechanism 123 can apply a first force $F_1$ (shown in FIG. 3D) to the first link 121 to urge the over-center spring device 120*a* to remain in the first position and the door 110 to remain in the closed position. In other embodiments, the forcing mechanism 123 can be positioned such that a movement of the door 110 out of the closed position will cause the first link 121 to compress the spring 124, which will create the first force $F_1$ to urge the over-center spring device 120*a* to return to the first position and the door 110 to return to the closed position (e.g., releasably retain the over-center spring device 120*a* in the first position and the door 110 in the closed position).

In the illustrated embodiment, the over-center spring device 120*a* includes a stop 130 mounted to the housing and connected at one end to the first link 121. In certain embodiments, the stops 130 can be located to restrict movement of the door 110 past selected positions. The first link 121 is pivotable relative to the stop 130 and the stop acts to react forces exerted on the first link 121. The lower portion of the stop 130 is positioned immediately adjacent to the door 110 when in the closed position. The stop 130 is configured to prevent the door 110 from moving in a direction opposite arrow A past the closed position. Because the stop 130 prevents the movement of the door 110 opposite arrow A (shown in FIG. 3D) past the closed position, in certain embodiments, the forcing mechanism 123 can apply a constant first force $F_1$ (shown in FIG. 3D) to the first link 121 to releasably retain the door 110 in the closed position. In yet other embodiments, the closure member control system 100 can include more or fewer stops 130, including no stops 130. In other embodiments, the closure member control system 100 can include other stop arrangements. For example, in other embodiments, the stop 130 includes one or more pins coupled to the housing and position so that the door 110 closes against the pin(s). In such embodiment, the first link 121 is pivotally anchored to the housing or other selected structure that will react forces applied to the first link.

The door 110 of the illustrated embodiment is pivotally coupled to the housing 102 at point $P_1$. Accordingly, the door 110 pivots about a point spaced apart from the end of the second link 122 that is attached to the door 110. When the door 110 is moved in the direction of arrow A (FIG. 3D) from the closed position toward the open position, the door 110 pulls on the second link 122 so as to move the over-center spring device 120*a* from the first position, toward a second position (shown in FIGS. 4A-4D). As the over-center spring device 120*a* begins to move from the first position to the second position, the second link 122 causes the first link 121 to pivot downwardly about point W. As the first link 121 pivots downwardly, the first link 121 compresses the spring 124 of the forcing mechanism 123. As the over-center spring device 120*a* moves to the second position, the first link 121 continues to compress the spring 124, and the forcing mechanism 123 begins to pivot downwardly about point $P_2$.

As the door 110 continues toward the open position, the first and second links 121 and 122 pivot to a transition position and the forcing mechanism 123 moves to an over-center position. As the forcing mechanism 123 approaches this over-center position, the forcing mechanism 123 continues to urge the door 110 toward the closed position. As the forcing mechanism 123 moves past the over-center position, it transitions from urging the door closed to urging the door open. The forcing mechanism applies a biasing force to urge the door 110 toward the open position. Accordingly, the forcing mechanism 123 provides a second force $F_2$ (shown in FIG. 4D) that causes the first link 121 to continue to arc in the direction of arrow A. As the over-center spring device 120*a* moves from the over-center position to the second position, compression on the forcing mechanism 123 is reduced.

In certain embodiments, the forcing mechanism 123 is in the over-center position when the forcing mechanism's connection points at X and $P_2$ are at least approximately coplanar with the first link's longitudinal axis. In other embodiments, the forcing mechanism 123 can have other arrangements. For example, in certain embodiments, the forcing mechanism 123 can have a different over-center position depending on the linkage arrangement. In other embodiments, a forcing mechanism 123 can be positioned to supply a tensile force that must be overcome to move the control device between the first and second positions.

When the over-center spring device 120*a* is in the second position as shown in FIGS. 4A-4D, the forcing mechanism 123 is positioned to releasably retain the over-center spring device 120*a* in the second position and the door 110 in the open position. For example, the forcing mechanism 123 can apply a second force $F_2$ (shown in FIG. 4D) to the first link 121 to urge the over-center spring device 120*a* to remain in the second position and the door 110 in the open position. In other embodiments, the forcing mechanism 123 can be positioned such that a movement of the door 110 out of the open position will cause the first link 121 to compress the spring which will create a second force $F_2$ (shown in FIG. 4D) to urge the over-center spring device 120*a* to return to the second position and the door 110 to return to the open position (e.g., releasably retaining the over-center spring device 120*a* in the second position and the door 110 in the open position).

Figure 4A:
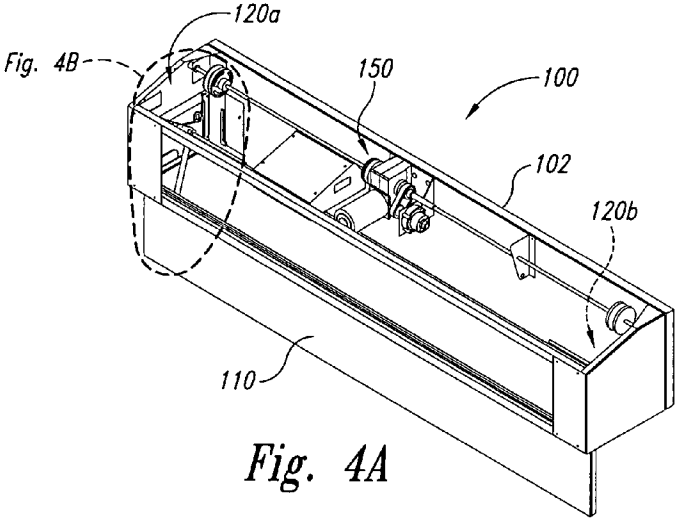
FIG. 4A is an enlarged isometric view of the closure member control system of FIG. 1, with the closure member in an open position and with the barrier removed.
Figure 4B:
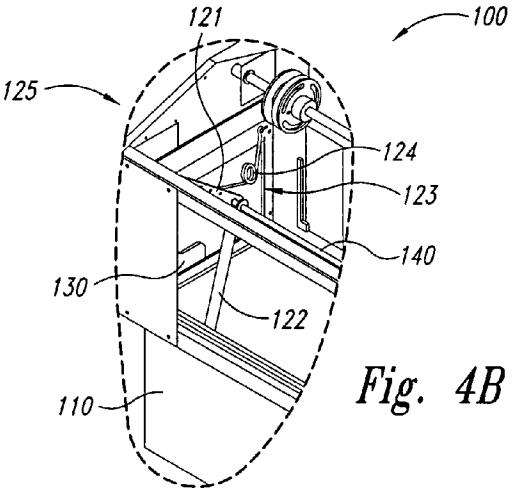
FIG. 4B is an enlarged detailed isometric illustration of a portion of the closure member control system shown in FIG. 4A.
Figure 4C:
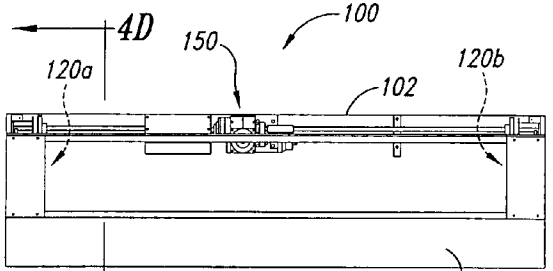
FIG. 4C is a partially schematic front elevation view of the closure member control system shown in FIG. 4A.
Figure 4D:
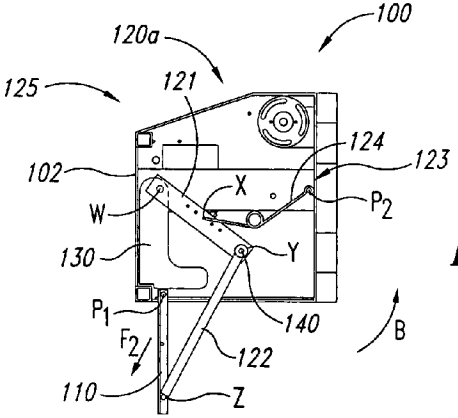
FIG. 4D is an enlarged cross-sectional side elevation view of the closure member control system taken substantially along line 4D-4D of FIG. 4C.

In order to move the over-center spring device 120*a* from the second position to the first position and the door 110 from the open position to the closed position, the first member 121 travels in an arc in the direction of arrow B (FIG. 4D). As the over-center spring device 120*a* moves from the second position to the first position, the first link 121 also arcs in the direction of arrow B (shown in FIG. 4D). As the over-center spring device 120*a* begins to move from the second position to the first position, the first link 121 compresses the spring 124 of the forcing mechanism 123. As the over-center spring device 120*a* moves to the first position, the first link 121 continues to compress the forcing mechanism 123 and the forcing mechanism 123 pivots about point $P_2$. As the forcing mechanism 123 passes through the over-center position, the forcing mechanism 123 transitions from applying the second force ($F_2$) to applying the first force $F_1$ (FIG. 3D) discussed above. Accordingly, in the illustrated embodiment, the spring 124 of the forcing mechanism 123 must be compressed to move the over-center spring device 120*a* from the first position to the second position and/or from the second position to the first position. Correspondingly, the spring 124 of the forcing mechanism 123 must be compressed to move the door 110 from the open position to the closed position and/or from the closed position to the open position. The over-center configuration allows the forcing mechanism 123 to bias the door 110 toward both the open and closed positions.

The over-center spring device 120*a* is described above in accordance with one embodiment. The over-center spring device 120*a* of other embodiments can include other arrangements. For example, the over-center spring device 120*a* can include more or fewer link portions and/or more or fewer forcing mechanisms 123. In certain embodiments, the door 110, the first link 121, the stop 130, and/or a portion of the forcing mechanism 123 can be attached directly to the wall 180 (shown in FIGS. 1 and 2) or coupled to the housing via the wall 180 and/or bracket(s). In the illustrated embodiment, the first over-center spring device 120*a* is adjustable to control the forces required to move the door 110 between the open and closed positions. The first link 121 includes multiple engagement holes H sized to pivotally receive the end of the forcing mechanism 123. The forcing mechanism 123 can be inserted into a selected one of the holes H to adjust the amount of force required to move the over-center spring device 120*a* out of the first or second position and/or to cause the forcing mechanism 123 to maintain a constant force on the first link 121 when the over-center spring device 120*a* is in the first or second position.

In the illustrated embodiment, the door 110 is automatically moved to the open position as the barrier 160 is being deployed. The barrier 160, when released by the drive mechanism discussed above, begins to unroll and falls via gravity against the door 110 in the closed position. The barrier 160 is heavy enough to overcome force $F_1$ (FIG. 3D) holding the door 110 in the closed position, thereby pushing the door 110 toward the open position. After the over-center spring devices 120 move the forcing mechanisms 123 past the over-center position, the forcing mechanisms 123 transition and the over-center spring devices snap the door 110 to the open position. Accordingly, the open door 110 does not interfere with the continued deployment of the barrier 160.

The closure member control system 100 is also configured to automatically return the door 110 to the closed position when the barrier 160 is returned from the deployed position to the stowed position. A positioning mechanism 140 is connected to the first over-center spring devices 120 at the pivotal connection of the first and second links 121 and 122, which corresponds to point Y (FIG. 3D). The positioning mechanism 140 projects from the first and second links 121 and 122 and is positional to engage a portion of the barrier 160 and/or spool 152 (shown in FIGS. 1 and 2) when the barrier approaches the stowed position. When the barrier 160 and/or spool 152 contact the positioning mechanism 140, the positioning mechanism 140 is lifted relative to the housing 102, thereby causing the first link 121 to pivot in the direction of arrow B (shown in FIG. 4D) and move the over-center spring device 120*a* from the second position toward the first position, thereby moving the door 110 from the open position toward the closed position. As the barrier 160 reaches the fully stowed position, the first link 121 moves the forcing mechanism 123 past the over-center position. The forcing mechanism 123 transitions and biases the door 110 toward the closed position. Accordingly, the over-center spring devices 120 then automatically pull the door 110 to the closed position as the barrier 160 is in the stowed position.

In other embodiments, the closure member control system 100 can have more or fewer positioning mechanisms 140, including no positioning mechanisms. In still other embodiments, the positioning mechanism can have other arrangements. For example, the positioning mechanism 140 can be coupled to other portions of the closure member control system 100 (e.g., the positioning mechanism 140 can be coupled directly to the door 110). In other embodiments, the positioning mechanism 140 can be manually operated via a handle external to the housing. In still other embodiments, the positioning mechanism 140 can be used to move the door 110 from the closed position to the open position.

The above-detailed embodiments of the invention are not intended to be exhaustive or to limit the invention to the precise form disclosed above. Specific embodiments of, and examples for, the invention are described above for illustrative purposes, but those skilled in the relevant art will recognize that various equivalent modifications are possible within the scope of the invention. For example, whereas steps are presented in a given order, alternative embodiments may perform steps in a different order. The various aspects of embodiments described herein can be combined and/or eliminated to provide further embodiments. Although advantages associated with certain embodiments of the invention have been described in the context of those embodiments, other embodiments may also exhibit such advantages. Additionally, none of the foregoing embodiments need necessarily exhibit such advantages to fall within the scope of the invention.

In general, the terms used in the following claims should not be construed to limit the invention to the specific embodiments disclosed in the specification unless the above-detailed description explicitly defines such terms. In addition, the inventors contemplate various aspects of the invention in any number of claim forms. Accordingly, the inventors reserve the right to add claims after filing the application to pursue such additional claim forms for other aspects of the invention.

We claim:

1. A closure member control system, comprising:

a housing having an interior, an opening to the interior, and a closure member movable relative to the opening between open and closed positions, the closure member in the closed position covers at least a portion of the opening and in the open position does not cover the at least a portion of the opening;

a barrier coupled to the housing and being moveable between a stowed position and a deployed position, the barrier being contained in the housing's interior when in the stowed position, and the barrier in the deployed position extends past the opening;

a control device operatively coupled to the closure member, the control device being movable between first and second positions relative to the housing, the control device being positioned to urge the closure member to remain in the closed position when the closure device is in the first position and to urge the closure member to remain in the open position when the closure device is in the second position; and a drive mechanism operatively coupled to the barrier and positioned to move the barrier to at least one of the stowed position and the deployed position, the drive mechanism including:

a spool coupled to the barrier wherein at least a portion of the barrier is wound on the spool and the barrier and the spool are generally positioned in the interior of the housing when the barrier is in the stowed position;

a cord coupled to the spool to retain the spool and the barrier in the stowed position, the cord being movable to lower the spool and a portion of the barrier past the opening as the barrier moves from the stowed position to the deployed position; and a positioning mechanism positioned to contact a portion of at least one of the barrier and the spool as the barrier is moved to the stowed position and to move the closure member from the open position to the closed position.

2. The system of claim 1 wherein the barrier includes at least one of a smoke curtain and a fire barrier.

3. The system of claim 1 wherein the control device includes an over-center locking mechanism.

4. The system of claim 1 wherein the control device includes a forcing mechanism, the forcing mechanism being positioned to urge the closure member to remain in the closed position when the control device is in the first position and to urge the closure member to remain in the open position when the control device is in the second position.

5. The system of claim 1 wherein the control device includes a forcing mechanism having at least one spring, the forcing mechanism being positioned to urge the closure member to remain in the closed position when the control device is in the first position and to urge the closure member to remain in the open position when the control device is in the second position.

6. The system of claim 1 wherein the control device includes:

a forcing mechanism having a spring;

a first link coupled to the forcing mechanism; and a second link pivotally coupled between the first link and the closure member, the first link and the spring positioned to create an over-center lock to urge the closure member to remain in the closed position when the closure member is in the closed position and to urge the closure member to remain in the open position when the closure member is in the open position.

7. The system of claim 1 wherein the control device includes:

a forcing mechanism having a spring;

a first link coupled to the forcing mechanism; and a second link pivotally coupled between the first link and the closure member, the first and second links positioned to compress the spring when the closure member is moved between the closed position and the open position.

8. The system of claim 1, further comprising a stop positioned to limit movement of the closure member in at least one direction.

9. The system of claim 1, further comprising a wall with an aperture, the housing being coupled to the wall above the aperture and positioned so that the barrier generally covers the aperture when the barrier is in the deployed position.

10. The system of claim 1 wherein, at least one of the spool and the barrier are positioned to contact the closure member as the barrier moves from the stowed position to the deployed position to move the closure member from the closed position to the open position.

* * * * *